US009718660B2

(12) United States Patent
Merlo

(10) Patent No.: US 9,718,660 B2
(45) Date of Patent: Aug. 1, 2017

(54) LIFTING VEHICLE WITH A TRANSVERSE STABILITY CONTROL SYSTEM

(71) Applicant: Merlo Project S.r.l., San Defendente di Cervasca (Cuneo) (IT)

(72) Inventor: Amilcare Merlo, San Defendente di Cervasca (IT)

(73) Assignee: Merlo Project S.r.l., San Defendente di Cervasca (Cuneo) (IT)

( * ) Notice: Subject to any disclaimer, the term of this patent is extended or adjusted under 35 U.S.C. 154(b) by 0 days.

(21) Appl. No.: 15/046,133

(22) Filed: Feb. 17, 2016

(65) Prior Publication Data

US 2016/0236922 A1 Aug. 18, 2016

(30) Foreign Application Priority Data

Feb. 18, 2015 (IT) ..... TO2015A0108

(51) Int. Cl.

| | |
|---|---|
| ***B66C 23/90*** | (2006.01) |
| ***B66F 9/075*** | (2006.01) |
| ***B66F 9/065*** | (2006.01) |
| ***B66F 17/00*** | (2006.01) |

(52) U.S. Cl.

CPC ..... *B66F 9/07559* (2013.01); *B66C 23/905* (2013.01); *B66F 9/065* (2013.01); *B66F 9/0655* (2013.01); *B66F 17/003* (2013.01)

(58) Field of Classification Search

None

See application file for complete search history.

(56) References Cited

U.S. PATENT DOCUMENTS

| | | | | |
|---|---|---|---|---|
| 6,157,889 | A | 12/2000 | Baker | |
| 2003/0060823 | A1 | 3/2003 | Bryan | |
| 2003/0060923 | A1* | 3/2003 | Scotese | B60G 9/02 700/217 |

(Continued)

FOREIGN PATENT DOCUMENTS

| | | | |
|---|---|---|---|
| DE | 102012015217 | A1 | 2/2014 |
| EP | 2520536 | A1 | 11/2012 |

(Continued)

OTHER PUBLICATIONS

Italian Search Report and Written Opinion dated Oct. 30, 2015 for Application No. TO2015A000108.

*Primary Examiner* — Truc M Do
*Assistant Examiner* — Jess Whittington
(74) *Attorney, Agent, or Firm* — Patterson & Sheridan, LLP

(57) ABSTRACT

A lifting vehicle comprising: a frame carrying a front axle and a rear axle; carrying a pair of front wheels and a pair of rear wheels, respectively; a lifting boom articulated in a rear section of the frame; and a stability control system configured to control the conditions of operational stability of the vehicle, wherein said stability control system comprises: a first and a second load sensor configured to provide information about the loads acting on the front right wheel and on the front left wheel and an electronic control unit programmed for: calculating a transverse dimension of the position of the center of gravity of the vehicle according to the values provided by said first load sensor and said second load sensor.

3 Claims, 8 Drawing Sheets

(56) References Cited

U.S. PATENT DOCUMENTS

| | | | | |
|---|---|---|---|---|
| 2006/0096137 | A1* | 5/2006 | Hendron | E02F 3/432 37/348 |
| 2010/0204891 | A1* | 8/2010 | Biggerstaff | E02F 3/3414 701/50 |
| 2012/0073843 | A1* | 3/2012 | Kure | B62D 55/084 172/407 |

FOREIGN PATENT DOCUMENTS

| | | | |
|---|---|---|---|
| GB | 2191868 | A | 12/1987 |
| GB | 2324871 | A | 11/1998 |
| WO | 2011022282 | A1 | 2/2011 |

* cited by examiner

LIFTING VEHICLE WITH A TRANSVERSE STABILITY CONTROL SYSTEM

CROSS-REFERENCE TO RELATED APPLICATIONS

This application claims benefit of Italian patent application number TO2015A000108, filed Feb. 18, 2015, which is herein incorporated by reference.

BACKGROUND OF THE INVENTION

Field of the Invention

The present invention relates to a lifting vehicle comprising:

a frame carrying a front axle and a rear axle, carrying a pair of front wheels and a pair of rear wheels, respectively;

a lifting arm articulated in a rear section of the frame; and a stability control system configured to control the conditions of operational stability of the vehicle.

Description of Prior Art

The reference legislation for stability control systems of lifting vehicles is the regulation EN15000. One of the main security features provided by the regulation EN15000 for vehicles with lifting arms is the control function of the risk of longitudinal rollover. To perform this safety function, micro-switches arranged on the rear axle are used, which detect when the rear axle load falls below a predetermined threshold. An electronic control unit alerts the operator to a situation of the risk of rollover and blocks the movements that aggravate the rollover risk.

The document EP-A-2520536 by the same Applicant describes a lifting vehicle equipped with a stability control system including an electronic control unit that receives information provided by: a length sensor, which detects the length of extension of the arm; an angle sensor, which detects the inclination angle of the telescopic arm, and by sensors that provide information on the type of equipment applied to the arm. The electronic control unit is programmed to act on a limiting valve in order to limit the maximum speed of lowering the arm depending on the type of equipment, the value of the load applied to the arm, and the length and angle of inclination of the arm.

The information on the type of equipment mounted on the arm, together with the information gathered from the various control sensors of the arm geometry and load weighing sensors carried by the arm allow the correct stability diagram to be provided to the operator, along with continuous information in real time on the instantaneous stability conditions of the vehicle.

However, this stability control system and those of lifting vehicles currently available on the market are configured to check only the longitudinal stability of the vehicle, or rather, the degree of stability against the risk of longitudinal rollover.

On the other hand, for the operational safety of lifting vehicles, transverse stability is also very important, especially in the case of vehicles that can also operate on uneven and rough terrains, such as some vehicles with lifting arms that are also usable as agricultural tractors. In fact, the transverse rollover is one of the most serious accidents with respect to agricultural vehicles.

SUMMARY OF THE INVENTION

The present invention aims to provide a lifting vehicle equipped with an improved stability control system, which also controls the transverse stability of the vehicle.

According to the present invention, this object is achieved by a lifting vehicle having the characteristics forming the subject of claim 1.

The stability control system according to the present invention comprises a first and a second load sensor, configured to provide information about the loads acting on the front left wheel and on the front right wheel of the vehicle. An electronic control unit is programmed: to calculate a transverse dimension of the position of the center of gravity of the vehicle as a function of the values provided by the first and the second load sensors; to compare the transverse dimension of the position of the center of gravity of the vehicle with reference values, and to report conditions of transverse instability of the vehicle when the calculated value of the transverse dimension of the center of gravity exceeds a corresponding reference value.

The transverse stability control system according to the present invention can be fully integrated with control systems of longitudinal stability already currently present on the current lifting vehicles. Therefore, thanks to the present invention, the lifting vehicles can be equipped with an integrated system of longitudinal and transverse stability control, which ensures total operational safety of lifting vehicles, by integrating the longitudinal (front and back) stability control with the transverse stability control.

The stability control system according to the present invention can use the signaling devices already present on normal production machines, such as, for example, a graphic display that shows the stability diagram of the vehicle, a signal light with three lights indicating the stability state of the vehicle and an acoustic warning. Thanks to these tools, the operator is informed in real time about the state of longitudinal and transverse stability of the vehicle, so as to be able to operate in complete safety up to the limit of the capacity of the vehicle.

BRIEF DESCRIPTION OF THE DRAWINGS

The present invention will now be described in detail with reference to the attached drawings, given purely by way of non-limiting example, wherein.

DETAILED DESCRIPTION

Figure 1:
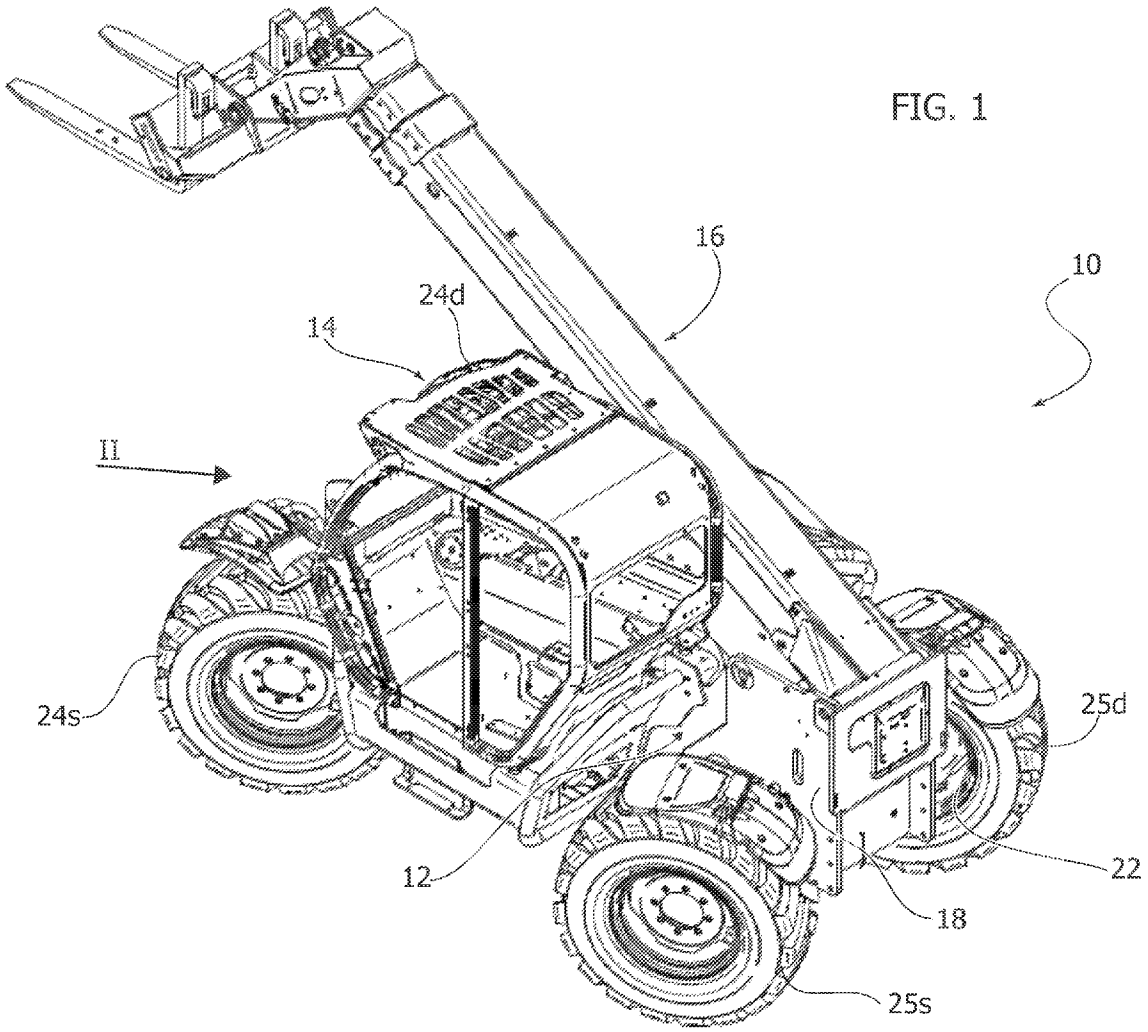
FIG. 1 is a perspective view of a lifting vehicle according to the present invention.
Figure 7:
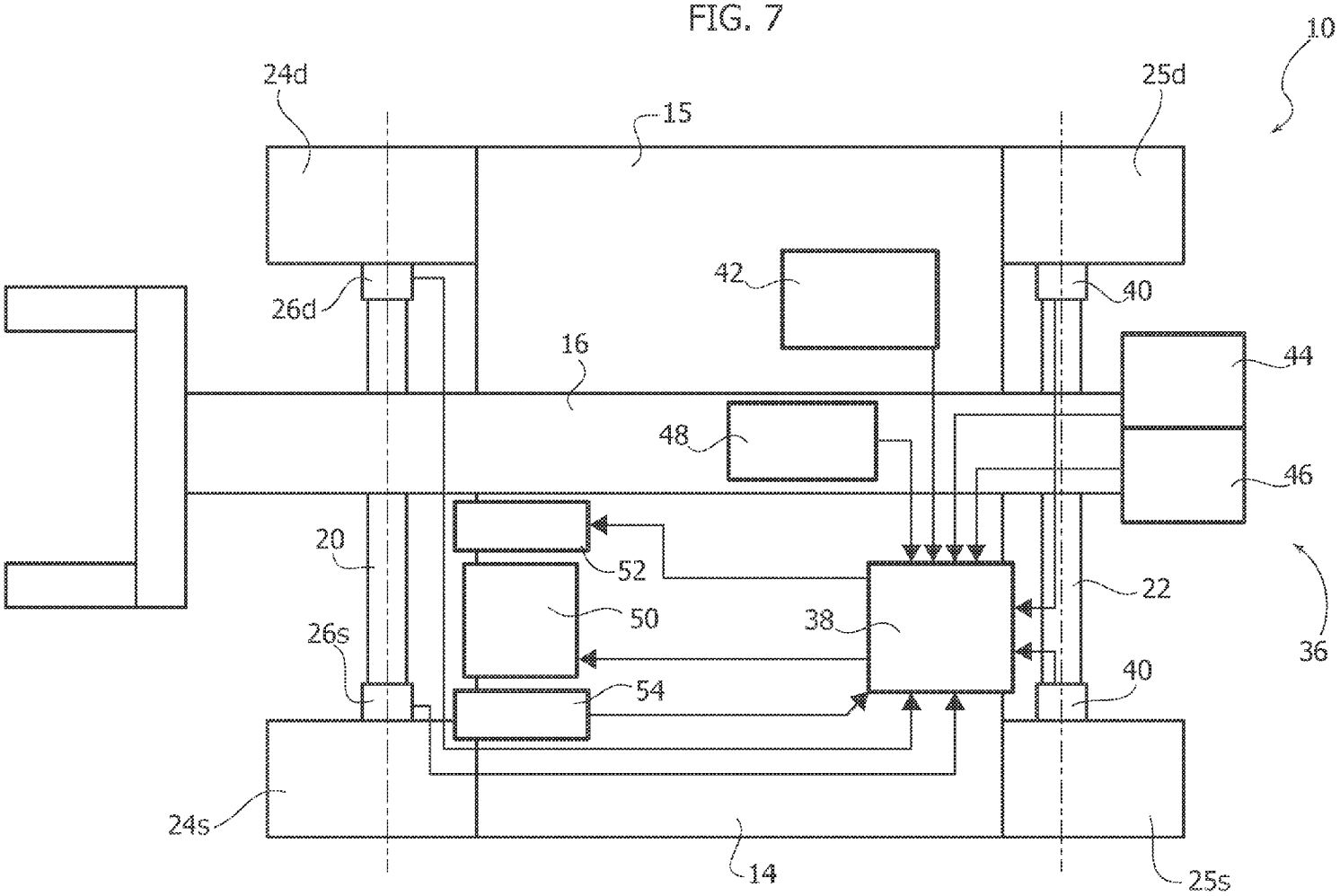
FIG. 7 is a schematic view of a stability control system according to the present invention.

With reference to FIG. 1, numeral 10 indicates a lifting vehicle comprising a frame 12 including a robust central longitudinal beam to which a control and driving cab 14 and a motor unit are fixed (schematically represented by 15 in FIG. 7). The motor unit and the control and driving cab are arranged on opposite sides of the frame 12. A lifting boom 16 is articulated to a rear section 18 of the frame 12.

The frame 12 carries a front axle 20 and a rear axle 22, carrying a pair of front wheels 24*d*, 24*s* and a pair of rear wheels 25*d*, 25*s*, respectively.

The vehicle 10 according to the present invention comprises a stability control system, which controls both the longitudinal stability and the transverse stability. To control the stability, the vehicle is provided with two load sensors 26*d*, 26*s* configured to detect the load on the front right wheel 24*d* and on the front left wheel 24*s*.

The lifting vehicles 10 can have a fixed or oscillating front axle 20. The load sensors 26*d*, 26*s* associated with the front wheels 24*d* and 24*s* can be of different types and can be arranged differently according to whether the front axle 20 is fixed or oscillating.

Figure 2:
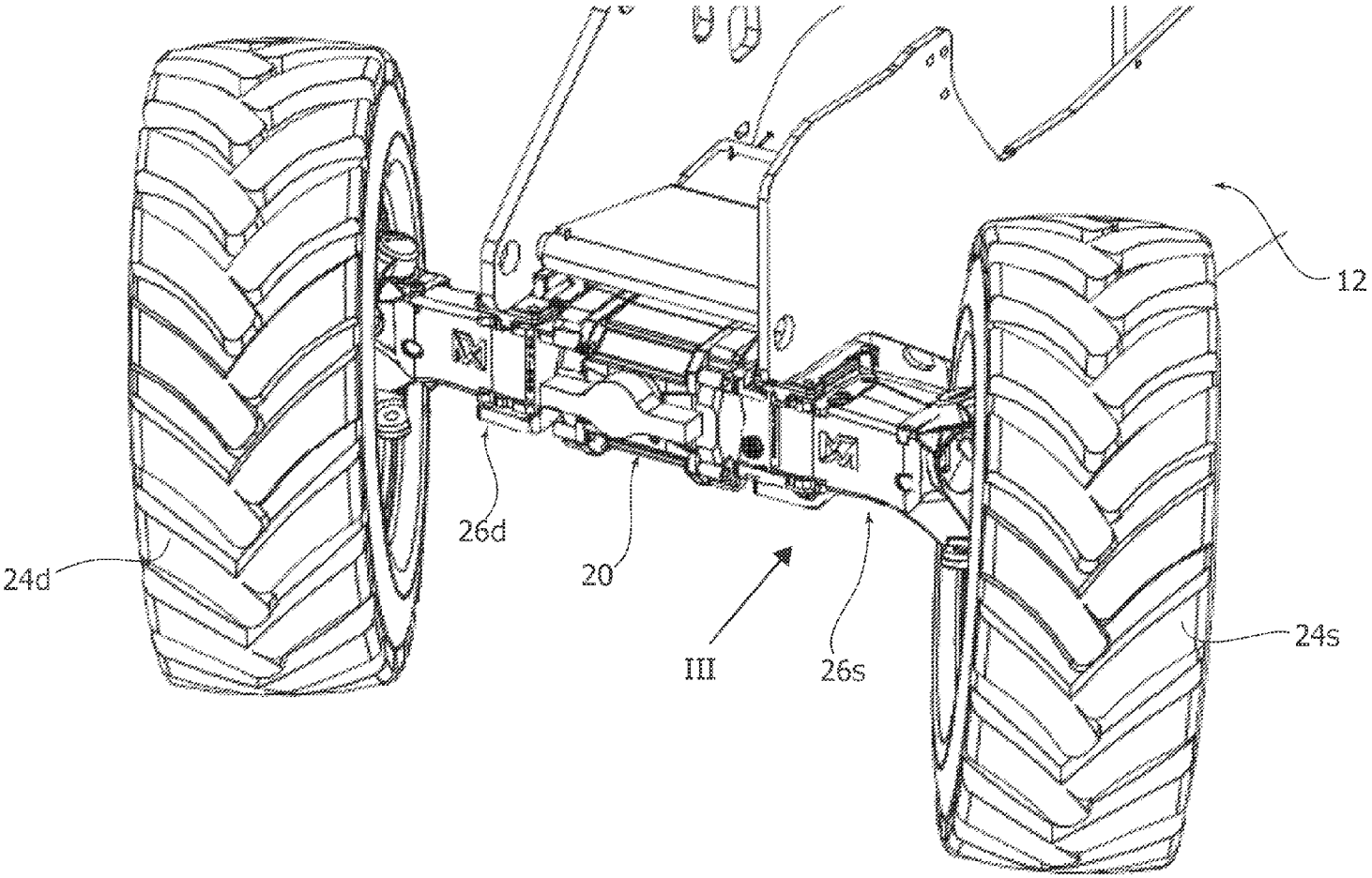
FIG. 2 is a perspective view of the part indicated by the arrow II in FIG. 1 of a vehicle with a fixed front axle.
Figure 3:
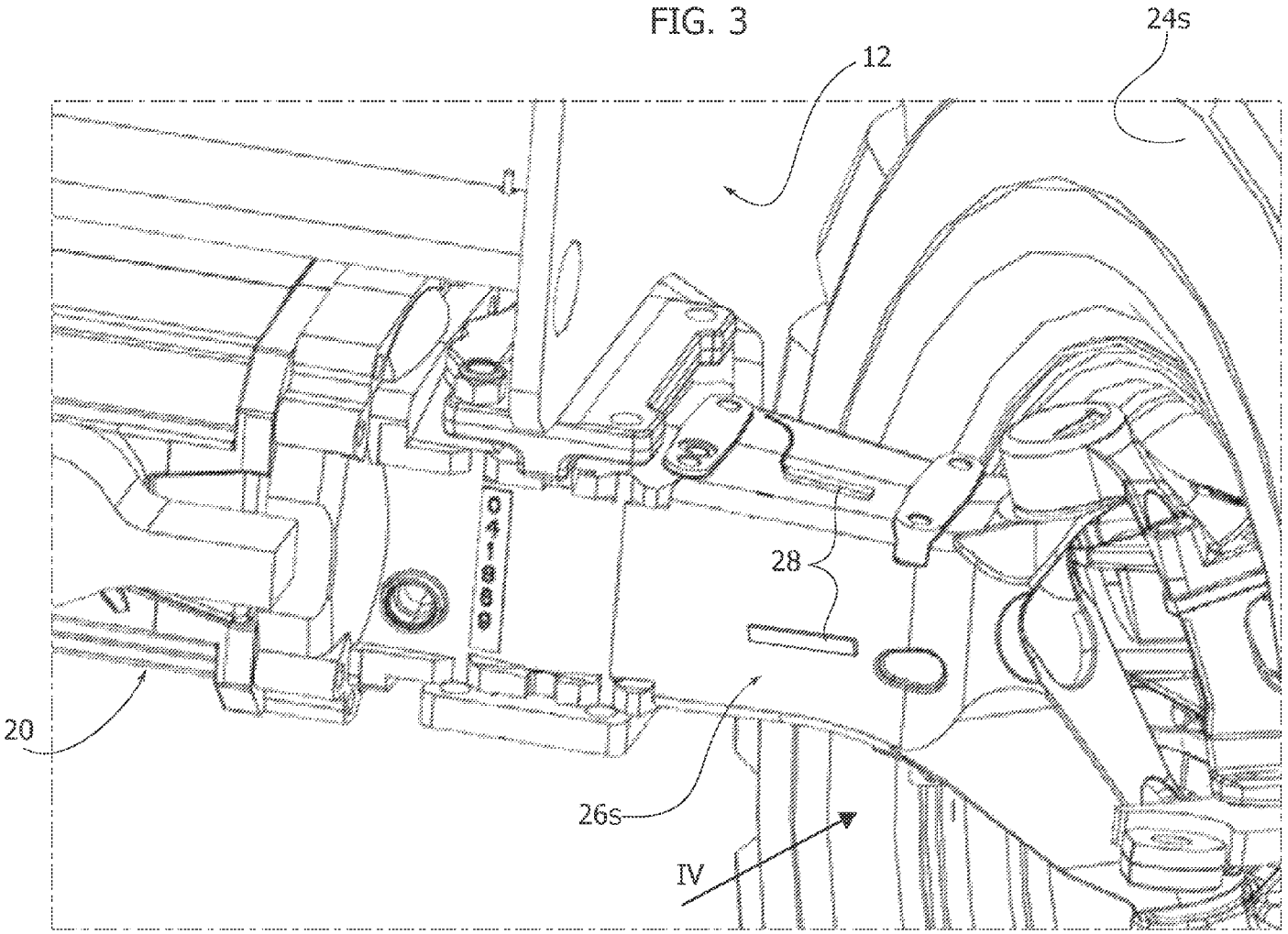
FIG. 3 is an enlarged perspective view of the detail indicated by the arrow III in FIG. 2, illustrating a first arrangement of the front axle load sensors.

FIG. 2 illustrates the case in which the front axle 20 is fixed with respect to the frame 12. In this case, the front axle 20 is essentially formed by a transverse beam fixed to the front end of the longitudinal beam 12 forming the frame of the vehicle. In this case, as shown in FIG. 3, the load sensors 26*d*, 26*s* can be formed by strain gauges 28 applied to the front axle 20 in the vicinity of the wheels 24*d*, 24*s*. The strain gauges 28 detect the deformation of the front axle 20 and provide a measure of the load that has generated this deformation.

Figure 4:
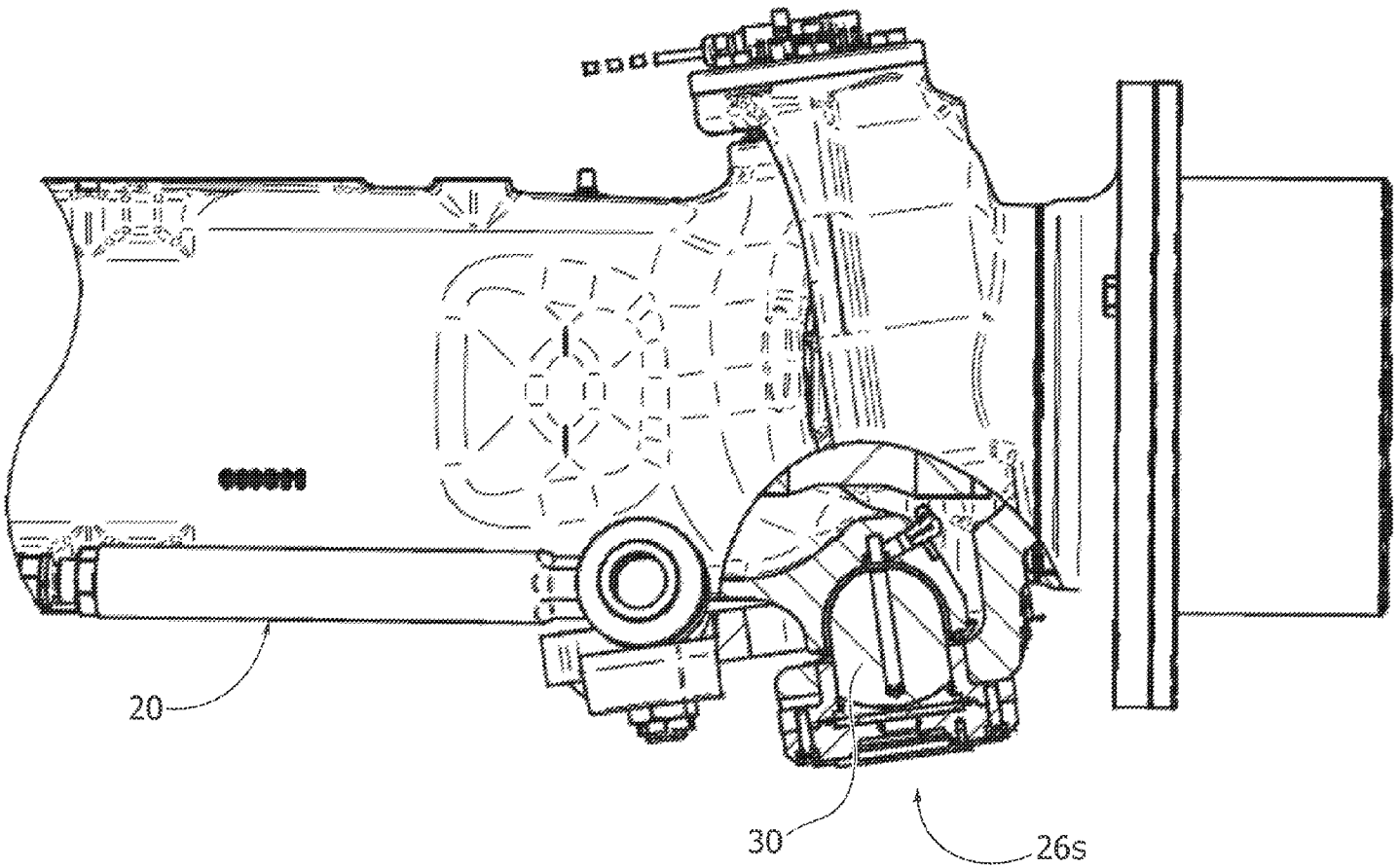
FIG. 4 is a partially sectioned view of the part indicated by the arrow IV in FIG. 3 illustrating a second arrangement of the front axle load sensors.
Figure 6:
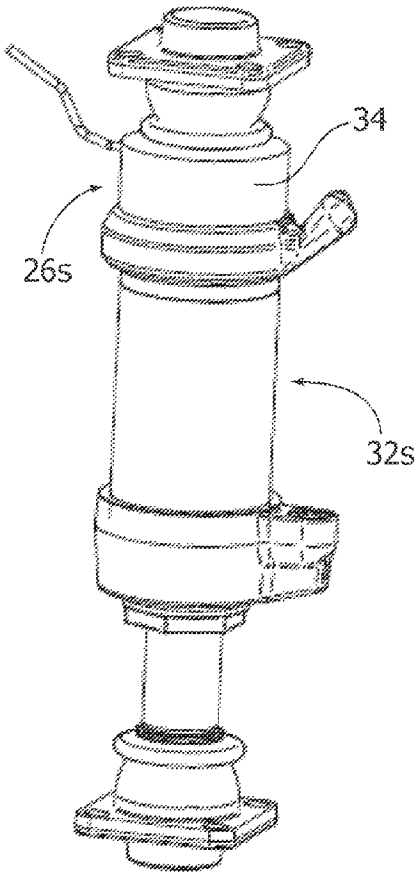
FIG. 6 is a perspective view of the part indicated by the arrow VI in FIG. 5 illustrating the arrangement of the load sensors in a vehicle with an oscillating axle.

Alternatively, as shown in FIG. 4, the load sensors 26*d*, 26*s* may be formed of respective load cells 30 mounted on the support of the reducer of the respective front wheel 24*d*, 24*s*.

Figure 5:
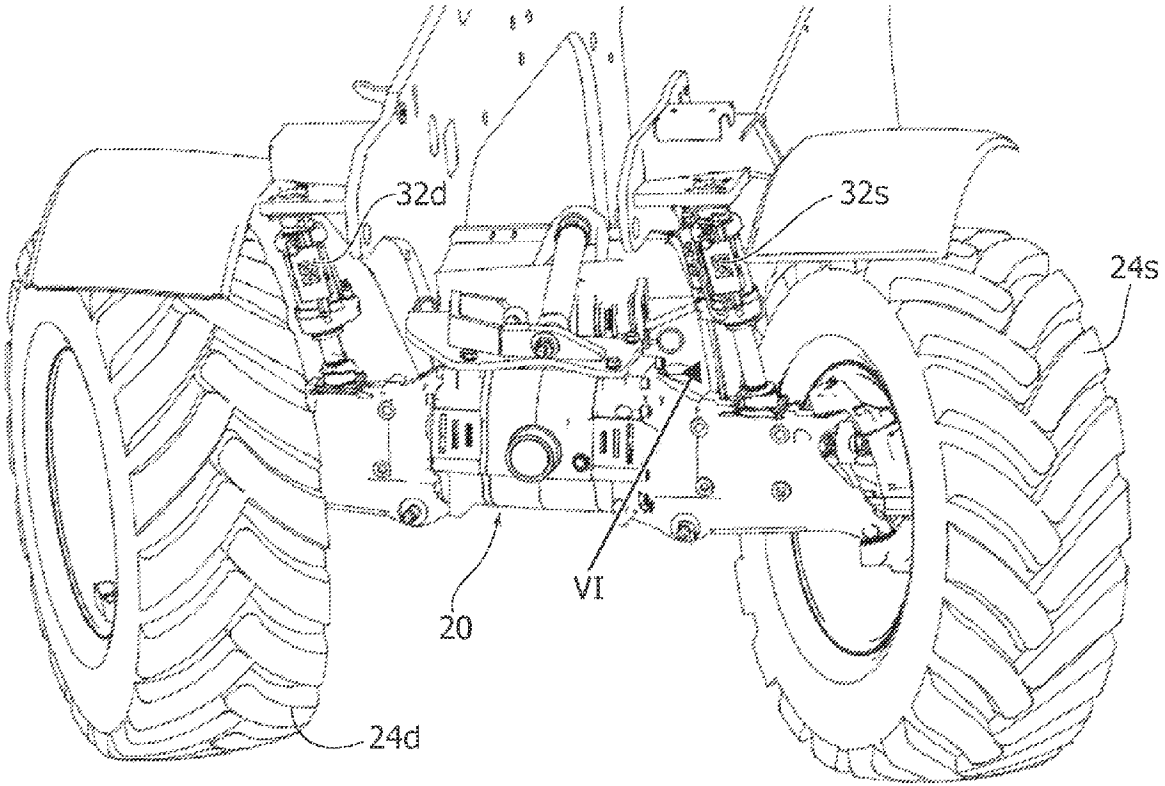
FIG. 5 is a perspective view illustrating the front part of a vehicle with oscillating front axle.

FIG. 5 illustrates an example in which the vehicle comprises an oscillating front axle 20. In this case, the front axle 20 is connected to the frame 12 of the vehicle by means of two hydraulic cylinders 32*s*, 32*d* arranged alongside the respective front wheels 24*s*, 24*d*. Each hydraulic cylinder 32*s*, 32*d* has an upper end fixed to the frame 12 and a lower end fixed to the front axle 20. In this case, the load sensors 26*d*, 26*s*, which detect the loads acting on the front wheels 24*d*, 24*s* can be formed by load cells 34 fixed to the respective cylinders 32*d*, 32*s*. For example, each load cell 34 can be fixed between the body of the cylinder 32*s*, 32*d*, and the upper fixing flange of the cylinder.

Whatever type of sensors used and their arrangement, the load sensors 26*d*, 26*s* are arranged to provide respective electrical signals indicative of the loads acting on the respective front wheels 26*d*, 26*s*.

FIG. 7 schematically illustrates a stability control system 36 according to the present invention. The stability control system 36 comprises an electronic control unit 38, which receives the signals coming from the load sensors 26*d*, 26*s* associated with the front wheels 24*d*, 24*s*. The electronic control unit 38 also receives signals coming from the two micro-switches 40 arranged on the rear axle 22 level with the rear wheels 25*s*, 25*d*.

The stability control system 36 comprises an absolute inclination sensor associated with the vehicle frame, which detects the absolute angle of longitudinal inclination of the vehicle relative to the ground. A relative angle sensor 44 is also provided, which detects the inclination angle of the boom 16 with respect to the vehicle frame. A sensor 46 is also provided, which detects the length of extension of the telescopic lifting boom 16 and a boom load sensor 48, which detects the load applied to the boom 16. The stability control system 36 also comprises a display 50, a signal light 52 and a selector 54 settable by the operator to select different operating modes of the stability control system 36.

The electronic control unit 38 carries out the control of the longitudinal stability of the vehicle 10 according to signals coming from the micro-switches 40 associated with the rear axle 22. When the micro-switches 40 indicate a condition of load on the rear axle 22 that is lower than a predetermined threshold, the electronic control unit 38 alerts the operator to a situation of danger of longitudinal rollover and blocks the movements that aggravate the risk of longitudinal rollover.

To control the transverse stability, the electronic control unit 38 calculates the transverse and longitudinal dimensions of the position of the center of gravity G of the vehicle 10 according to the signals coming from the load sensors 26*d*, 26*s* of the front wheels 24*d*, 24*s* of the boom load sensor 48.

Figure 9:
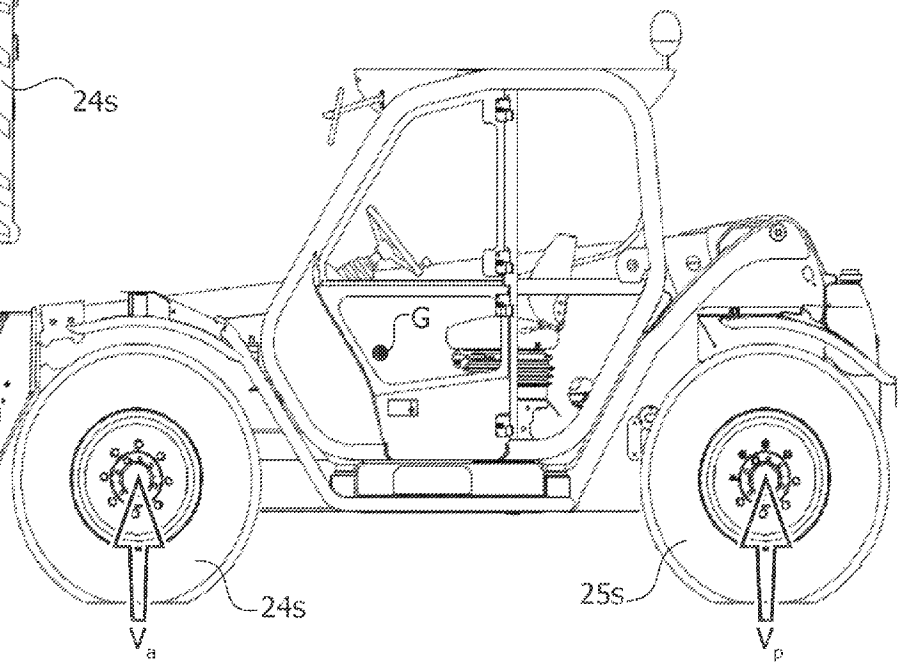
FIGS. 8 and 9 are front and side views of a lifting vehicle illustrating the distribution of loads in the transverse direction and in the longitudinal direction.
Figure 8:
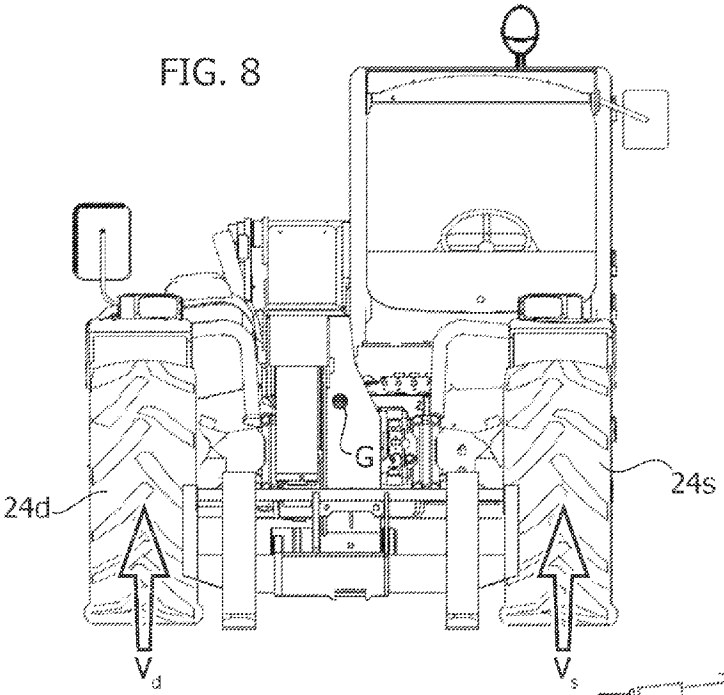

With reference to FIGS. 8 and 9, the transverse dimension Y of the position of the center of gravity G of the vehicle 10 is calculated by the following expression:

$$Y = \frac{V_d}{V_d + V_s}$$

wherein:

Y is the distance of the center of gravity G from the center of the right wheel 24*d;*

$V_d$ is the vertical load acting on the right wheel 24*d*, measured by the load sensor 26*d*; and $V_s$ is the vertical load acting on the left wheel 24*s*, measured by the load sensor 26*s*.

With reference to FIG. 9, the longitudinal dimension X of the position of the center of gravity G of the vehicle is calculated according to the load on the front axle $V_a$ and of the load on the rear axle $V_d$.

The load on the front axle $V_a$ is given by the following expression:

$$V_a = V_d + V_s$$

wherein $V_d$ and $V_s$ are the load values on the front wheels 24*d*, 24*s* measured by the load sensors 26*d*, 26*s*.

The load on the rear axle $V_p$ is calculated by the following expression:

$$V_p = P_m \cos \alpha + P_c - V_a$$

wherein:

$V_p$ is the load on the rear axle;

$P_m$ is the weight of the unloaded machine, which must be evaluated by a preliminary calibration;

$\alpha$ is the absolute inclination angle of the vehicle with respect to the ground;

$P_c$ is the weight of the load applied to the boom 16 detected by the boom load sensor 48; and $V_a$ is the load on the front axle calculated as previously indicated.

Note that in the case in which the machine is inclined, the load sensors 26*d*, 26*s* and 48 detect the load perpendicular to the support plane, while the weight of the machine for the correct balance of the forces must be multiplied by cos $\alpha$, where a is the angle detected by the sensor of absolute longitudinal inclination of the vehicle 10.

The relationship that provides the longitudinal dimension of the position of the center of gravity G of the vehicle is the following:

$$X = \frac{V_a}{V_a + V_p}$$

The preliminary calibration for determining the weight of the machine $P_m$ is carried out in the following way:

a sample load of known weight is chosen;

the machine is loaded with the sample weight;

the boom 16 is extended until the micro-switches 40 of the rear axle 22 are engaged; and at this point $V_d$ and $V_s$ are measured and the weight of the machine is calculated with the expression: $P_m=V_d+V_s-P_c$.

The weight of the machine $P_m$, determined in this way, is not exactly equal to the actual weight of the machine. However, using this value, the system is calibrated so that the indicator on the display is in the emergency zone of front rollover at the exact moment in which the antirollover micro-switches 40 of the rear axle 22 are activated.

Figure 12:
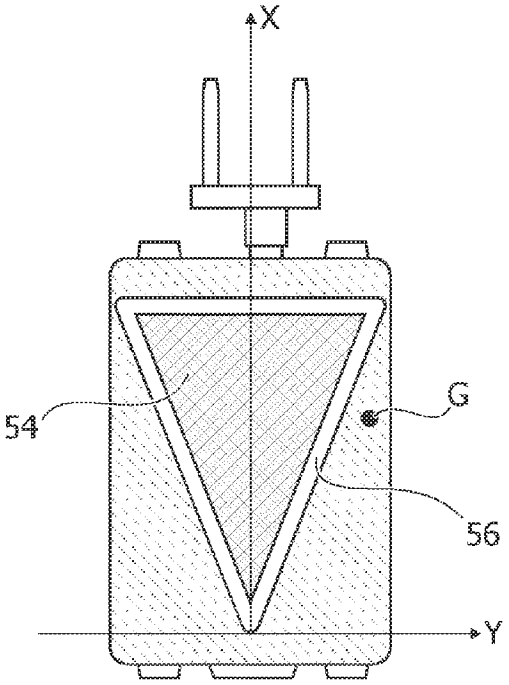
FIGS. 10, 11 and 12 are schematic views illustrating the stability diagram of the vehicle in three different operating situations.
Figure 11:
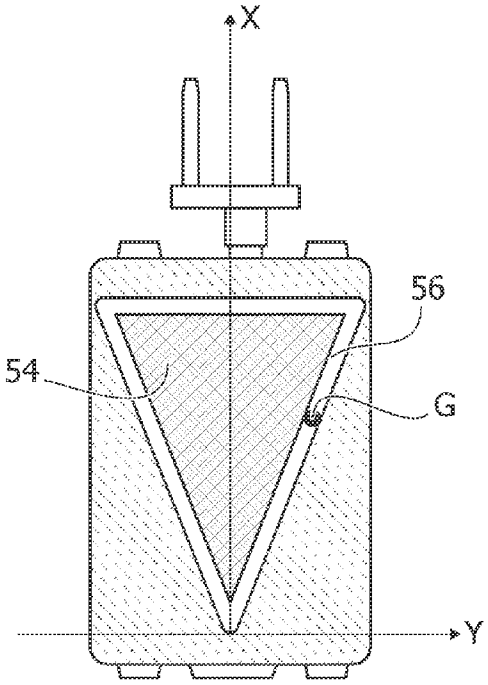
Figure 10:
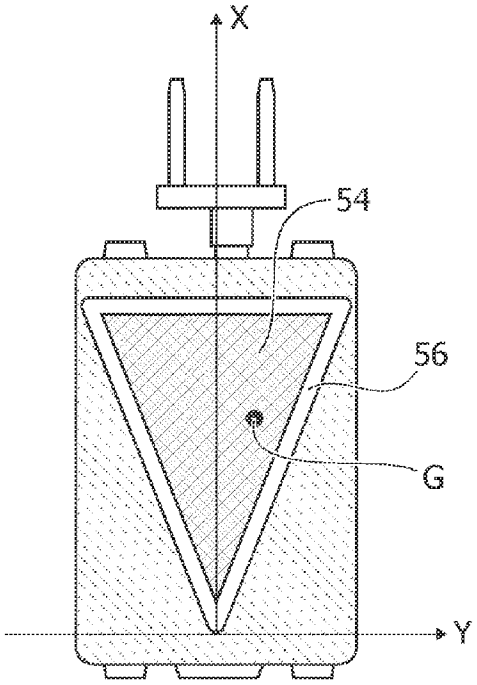

With reference to FIGS. 10, 11 and 12, the electronic control unit 38 shows the position of the center of gravity G of the vehicle on the display 50, calculated as previously indicated. The position of the center of gravity G is represented on a stability diagram of the vehicle. The stability diagram has the shape of an isosceles triangle with its vertex at the center of the rear axle 22 and the base parallel to the front axle 20.

The inclined sides of the triangle represent, for each longitudinal dimension X of the position of the center of gravity G, the limit values of the transverse dimension Y above which the vehicle is at risk of transverse rollover.

The areas within the area indicated with 54 represent operational conditions of full safety of the vehicle. These operating conditions are indicated by a green signal light 52.

On the stability diagram of the vehicle a perimetral band 56 that surrounds the triangle 54 is reported. When the calculated position of the center of gravity G is located in the band 56, the vehicle is in working conditions at the limit of transverse rollover. These conditions are indicated by a yellow light of the signal light 52. Finally, FIG. 12 represents the case in which the calculated position of the center of gravity G is outside of the band 56. In these conditions, the vehicle is in a critical working condition, at a high risk of longitudinal or transverse rollover. This condition is indicated by a red signal light 52.

Thanks to the stability control system according to the present invention, the operator is able to prevent the vehicle rollover in all directions, also due to external causes to the use of the vehicle. In fact, the loss of stability, especially lateral, is due to the conditions in which the vehicle is operating, regardless of the load diagram prepared in accordance with existing standards. For example, an inappropriate inflation of the tires, an uneven or yielding terrain, the lifting of an unbalanced load, etc. may be the cause of side rollover, even within the operating limits provided by the load diagrams. The stability control system according to the present invention is able to recognize these dangerous situations and to inform the operator about the real state of the vehicle stability.

Of course, without prejudice to the principle of the invention, the details of construction and the embodiments can be widely varied with respect to those described and illustrated, without thereby departing from the scope of the invention as defined by the claims that follow.

The invention claimed is:

1. A lifting vehicle comprising: a frame carrying a front axle, the front axle comprising a front right wheel and a front left wheel, and a rear axle, carrying a pair of rear wheels; a lifting boom articulated in a rear section of the frame; a first load sensor configured to provide a measure of a first wheel load acting on the front right wheel; a second load sensor configured to provide a measure of a second wheel load acting on the front left wheel; a boom load sensor configured to provide a measure of a boom load; an electronic control unit configured to receive the measure of the first wheel load, the measure of the second wheel load, and the measure of the boom load; and a display configured to connect to the electronic control unit and configured to show a vehicle stability diagram, the vehicle stability diagram having a stable area and an instable area, wherein: the display shows a position of a center of gravity of the lifting vehicle; the position of the center of gravity of the lifting vehicle relative to the vehicle stability diagram has a transverse dimension and a longitudinal dimension; the display shows a condition of lateral stability of the lifting vehicle when the center of gravity of the lifting vehicle is contained in the stable area and a condition of lateral instability when the center of gravity of the lifting vehicle is contained in the instable area; the electronic control unit is configured to calculate the transverse dimension of the position of the center of gravity of the lifting vehicle according to the measure of the first wheel load and the measure of the second wheel load; the electronic control unit is configured to calculate the longitudinal dimension of the position of the center of gravity of the lifting vehicle according to the load on the front axle is given by the sum of the first wheel load and the second wheel load; the load on the rear axle is calculated according to an unloaded weight of the lifting vehicle, the inclination angle of the frame relative to the ground, and the measure of the boom load; and the electronic control unit is configured to restrict movement of the lifting vehicle based on the calculation of the position of the center of gravity of the lifting vehicle.

2. The lifting vehicle according to claim 1, further comprising a pair of micro-switches arranged on the rear axle of the lifting vehicle and configured to provide a signal to the electronic control unit when the load on the rear axle is lower than a predetermined reference threshold.

3. The lifting vehicle according to claim 2, further comprising a relative tilt sensor configured to provide a measure of the inclination angle of the lifting boom, relative to the frame, to the electronic control unit.

* * * * *